United States Patent [19]

Siskin et al.

[11] Patent Number: 4,576,707

[45] Date of Patent: Mar. 18, 1986

[54] PROCESS FOR BENEFICIATING COAL

[75] Inventors: Michael Siskin, Livingston; Glen B. Brons, Phillipsburg, both of N.J.

[73] Assignee: Exxon Research and Engineering Co., Florham Park, N.J.

[21] Appl. No.: 686,609

[22] Filed: Dec. 27, 1984

Related U.S. Application Data

[63] Continuation-in-part of Ser. No. 600,431, Apr. 16, 1984, Pat. No. 4,491,513.

[51] Int. Cl.[4] ..... C10G 1/04

[52] U.S. Cl. ..... 208/8 LE

[58] Field of Search ..... 208/8 LE, 11 LE; 423/114, 119, 131, 130, 157, 658.5

[56] References Cited

U.S. PATENT DOCUMENTS

| | | | |
|---|---|---|---|
| 3,503,705 | 3/1970 | Tackett | 423/119 |
| 3,516,787 | 6/1970 | Van Nordstrand | 423/119 |
| 3,642,433 | 2/1972 | Dyni | 423/119 |
| 3,721,730 | 3/1973 | Haas | 423/119 |
| 3,821,353 | 6/1974 | Weichman | 423/119 |
| 3,859,413 | 1/1975 | Haas | 423/119 |
| 3,962,403 | 6/1976 | Wyslouzil | 423/206 R |
| 4,176,042 | 11/1979 | Fahlström | 423/658.5 |
| 4,250,016 | 2/1981 | Estes et al. | 208/11 LE |
| 4,342,729 | 8/1972 | Garcia Clavel et al. | 423/131 |
| 4,408,999 | 10/1983 | Nadkarni et al. | 208/11 LE |
| 4,490,238 | 12/1984 | Siskin | 208/11 LE |
| 4,491,513 | 1/1985 | Siskin et al. | 208/11 LE |
| 4,491,514 | 1/1985 | Siskin et al. | 208/11 LE |

*Primary Examiner*—John Doll
*Assistant Examiner*—A. Pal
*Attorney, Agent, or Firm*—Henry E. Naylor

[57] ABSTRACT

Disclosed is a process for beneficiating coal by contacting the coal with (a) an ammonium salt solution and (b) an organic solvent, at a temperature from about 0° C. to about 300° C.

26 Claims, No Drawings

PROCESS FOR BENEFICIATING COAL

CROSS REFERENCE TO RELATED APPLICATIONS

This application is a continuation-in-part application of copending Ser. No. 600,431, filed Apr. 16, 1984 now U.S. Pat. No. 4,491,513.

BACKGROUND OF THE INVENTION

The present invention relates to the beneficiation of coal by treating the coal with an aqueous ammonium salt solution and an organic solvent at a temperature from about 0° C. to about 300° C. for a time sufficient to remove minerals from the coal.

Many process have been developed to utilize coal directly in solid form by combustion, or by first converting it to useful liquids and gases. However, many of these processes suffer because of problems associated with the mineral matter contained in coal. For example, mineral matter in coal can cause recycle problems in liquefaction processes by causing the loss of hydrogen to form the undesirable side product $H_2S$. Mineral matter can also be a problem if the coal is burned directly because mineral matter contributes to slagging problems. Mineral matter in coal will also contribute to the release of sulfur dioxide as a pollutant. Consequently, it is highly desirable to remove as much of the mineral matter as possible before coal utilization.

Although various methods have been proposed for the removal of mineral matter from coal, there is still a need in the art for the development of more efficient and effective demineralization, or beneficiation, methods.

Much work has recently been done to develop efficient methods for acquiring useful liquids and gases from oil-shale as replacements for petroleum products. The inherent mineral matter in oil-shale represents significant debits in both handling and processing. Typically, the organic material which can be converted to useful fuels and chemical feedstock, preferably liquids, represents only about 10–25 wt.% of the oil-shale. Furthermore, during processing there is considerable increased abrasive wear on preparation and conversion plants owing to the nature of mineral matter contained in oil-shale. Also, relatively large reactor sizes are required to accommodate the higher material throughputs necessitated by the large quantities of mineral matter. Most important is the fact that large quantities of rock must be heated to relatively high temperatures in order to breakdown the kerogen of the oil-shale to liquid and gaseous products. This results in a loss in energy efficiency because much of this heat is not recoverable as useful work. Also, processes which include a catalyst are faced with a significant potential that the mineral matter inherently present in the oil-shale contributing to catalyst poisoning. Consequently, various processes have been developed over the years to beneficiate, or demineralize, oil-shale prior to further processing to concentrate the organic material and alleviate the above mentioned problems associated with oil-shale processing.

Although both physical and chemical methods have been developed for separating organic material oil-shale, thereby leaving substantially all of the mineral matter behind, chemical methods usually are superior over physical methods because of better separation obtained. One conventional type of chemical method for the separation of kerogen from oil-shale is acid dissolution of the inorganics. Such a technique typically involves the digestion of oil-shale with hydrochloric acid, hydrofluoric acid, or both. The hydrochloric acid dissolves the carbonate minerals and the hydrofluoric acid dissolves the silicate and clay minerals, thereby leaving a kerogen material containing about 5 to 10 wt% mineral matter. Although such schemes have met with varying degrees of success, they suffer the disadvantages of being corrossive and, in most cases, the inability to regenerate the acid reactants economically for recycle makes the process unattractive.

A variation in this acid technique is one disclosed by R. D. Thomas in Fuel, 48, 75–80 (1969) wherein all of the mineral carbonates are removed from Green River oil-shale by treatment with carbonic acid. Thomas discloses that after sodium hydroxide washing to remove fine clay-like particles, the carbonate-free material can be centrifuged in a saturated aqueous calcium chloride solution to yield a concentrate containing 85–95 wt% of the original kerogen with an ash content of less than 30 wt.%. Attempts to reproduce the physical separation results after demineralization with carbonic acid have been unsuccessful. See Vandergrift, G. F., Winans, R. E., and Horwitz, E. P., Fuel, 59, 634–6 (1980).

A variation of using acids to enrich the kerogen content of oil-shales which are rich in carbonates involves leaching by use of a sulfuric acid medium generated by the oxidizing capabilities of specific bacteria which convert pyrite in the oil-shale to sulfuric acid. The sulfuric acid produced decomposes the carbonate minerals in the oil-shale leaving a kerogen enriched material containing significant amounts of silica. See U.S. Pat. No. 4,043,884.

Other approaches to chemical beneficiation include extraction of low grade Western U.S. oil-shales with aliphatic amides to recover 69 wt.% to 83 wt% of the organics (U.S. Pat. No. 4,357,230), and treatment of various oil-shales with a 1:1 mixture of trichloroisocyanuric acid and a chlorine donor such as calcium hypochlorite in the presence of a petroleum based naphtha solvent giving recoveries of organics up to about 98 wt% (U.K. Pat. No. 2,090,858).

Furthermore, disclosed in Intl. Patent Appl. Wo No. 82/03404 is a two-step treatment of oil-shale with 16 parts of fused alkali metal caustic at 350° C. for 40 minutes followed by a sulfuric acid wash which led to recovery of 86 wt.% of the organics. This type of treatment suffers from the disadvantage that it may have a detrimental effect on the kerogen structure and reactivity.

Although various methods have been used, including physical grinding combined with chemical treatment, for beneficiating oil-shale, such prior art methods have not been able to effect a significant separation of mineral matter from the organic material under relatively mild conditions without the reagent being simultaneously and irreversibly destroyed. Consequently, there is still a need in the art for processes which are able to beneficiate oil-shale under relatively mild conditions and leave the benefication reagent in a form which is easily regenerable. Furthermore, none of the prior art methods suggest the use of ammonium salts for beneficiating oil-shales.

SUMMARY OF THE INVENTION

In accordance with the present invention there is disclosed a process for beneficiating coal which process comprises contacting the coal with: (a) an ammonium salt solution and (b) an organic solvent, at a temperature from about 0° C. to about 300° C.

In preferred embodiments of the present invention, the coal is contacted at a temperature from about 60° C. to about 250° C. and the ammonium salt is selected from the group consisting of ammonium carbonate, ammonium bicarbonate, ammonium acetate, ammonium chloride, ammonium nitrate, ammonium phosphates, and ammonium sulfate, and at least a portion of the organic solvent is a coal derived liquid.

For other preferred embodiments of the present invention a nonionic surfactant is used.

DETAILED DESCRIPTION OF THE INVENTION

The general composition and characteristics of oil-shales and coals are well known (See "Kerogen" edited by B. Durand, Editor Technip, Paris 1980 and "Coal" by D. W. van Krevelen, Elsevier, Amsterdam 1961) and will, therefore, not be described in detail herein.

Coals which are beneficiated in accordance with the present invention are bituminous, subbituminous, lignite, and the like. Typically, such coals have a carbon content ranging from about 55 to 95 wt.%; a hydrogen content ranging from about 2.2 to 6.2 wt.%, and an oxygen content ranging from about 3 to 23 wt.% (DMMF-dry, mineral matter free); and an H/C ratio ranging from about 0.3 to 1.1.

For practical purposes, the oil-shale should contain at least about 5, preferably at least about 10, and more preferably at least about 20% by weight of organic material, based on the total weight of the oil-shale. Such oil-shales usually contain at least about 7.5, preferably at least about 15, and more preferably between about 25 and 75 gallons of oil per ton of oil-shale, by Fischer Assay.

Although the particle size of the coal or oil-shale is not critical, it is preferred for convenience of handling that it be crushed to a particle size having an average diameter of less than about 1 inch, preferably less than about ½ inch. The diameter of the particles as referred to herein is the smallest size of the screen opening through which particles of the designated "diameter" will pass.

Ammonium salts suitable for use in the instant invention are ammonium salts of organic and inorganic acids. Preferred are the ammonium salts of strong mineral acids. Nonlimiting examples of such ammonium salts suitable for use herein include ammonium carbonate, ammonium bicarbonate, ammonium acetate, ammonium chloride, ammonium nitrate, ammonium sulfate, and ammonium phosphates. Preferred are ammonium nitrate and ammonium sulfate, more preferred is ammonium sulfate.

Organic solvents suitable for use herein are those which are substantially insoluble with water. Non-limiting examples include toluene, heptane, BTX streams, cyclohexane, petroleum and coal derived fractions, and boiling point fractions of oil-shale liquids. By BTX streams, we mean a stream comprised essentially of benzene, toluene, and xylene. Preferred is a boiling point shale-oil or coal liquid fraction. For example, a middle to high boiling point fraction or more preferably one which is a conversion product of the instant invention, and mixtures thereof.

In the practice of the present invention, the ratio (by volume) of solvent to aqueous solution will range from about 0.4:1 to 2:1, preferably from about 0.4:1 to 0.6:1.

It is also within the scope of the present invention to use a surfactant, which can act as either a wetting agent to improve the aqueous phase-mineral contacting or as a sacrificial adsorbant thereby weakening the mineral-organic interactions. Anionic and cationic sufactants are not suitable herein because they are unable to achieve a physical separation of a the organic rich material from the mineral matter after the coal or oil-shale is treated with the ammonium salt solution. The amount of surfactant which can be used herein will be in excess of about 0.1 wt.%, based on the weight of the ammonium salt solution.

Non-limiting examples of such nonionic surfactants include ethoxylated derivatives of phenols, amines, carboxylic acids, alcohols and mercaptans, as well as polyhydroxy compounds. The ethoxylated phenols may have the formula:

$$(R)r^{A}—[O(CH_2CH_2O)p]q^{H}$$

wherein R is a $C_1$ to $C_{24}$ alkyl, A is benzene, naphthalene or diphenyl, p is 2 to 60, q is 1 or 2 and r is 1 to 5 with the proviso that when r is 1, R is at least $C_8$. Preferred nonionic surfactants are ethoxylated $C_8$–$C_{24}$ alkylphenols, ethoxylated octyl, nonyl or dodecyl phenols containing 8 to 24 —$CH_2CH_2O$—groups, or ethoxylated dimonyl phenols containing 8 to 50 —$CH_2CH_2O$—groups.

Ethoxylated amines may be cationic or nonionic depending on the degree of ethoxylation. Higher degrees of ethoxylation render fatty amines nonionic in character. Preferred amines are $C_8$ to $C_{30}$ alkyl amines, $C_8$ to $C_{30}$ ethoxylated amines or quaternary ammonium salts thereof. Ethoxylated amines of the formula:

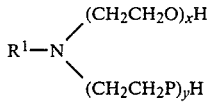

where $R^1$ is a $C_8$ to $C_{30}$ aliphatic radical and the sum of x+y is from 2 to 30.

Aliphatic carboxylic acids of from 8 to 30 carbon atoms can be esterified with ethylene oxide to form nonionic surfactants. The degree of ethoxylation may be from 2 to 30. Also, $C_8$ to $C_{25}$ alkanols and mercaptans can be converted to polethoxy ethers and thio-ethers by reaction with ethylene oxide.

Examples of nonionic surfactants which are not polyethoxylated are esters of sugar alcohols, sorbitol and mannitol. The acid moiety of the ester is generally a fatty acid. Other fatty acid derivatives include esters of di- and poly saccharides and condensates of fatty acids with alkanolamines.

The temperatures at which the instant process are carried out will generally be at temperatures from about 0° C. to about 100° C. when atmospheric pressure is employed. If higher pressures are employed the temperature can be as high as about 300° C. Preferred is a temperature from about 75° C. to about 250° C. If salts such as ammonium carbonate and ammonium bicarbonate are used, which decompose at temperatures greater than about 50° C., elevated pressures must be used to keep the components of the salts in solution. Also, proper steps must be taken to maintain low $CO_2$ partial pressures so as not to impede carbonate mineral decomposition.

In the practice of the present invention, the coal is contacted with the ammonium salt solution for an effective amount of time in an appropriate reactor at a temperature from about 0° C. to about 300° C.; that is, for a time sufficient to remove a desired amount of minerals from the coal. It will be appreciated that the specific amount of time and temperature will be dependent on such things as, the ammonium salt, the amount of ammonium salt, pressure, and particle size of the coal employed.

The process of the instant invention may be carried out in more than one pH stage wherein each stage may consist of one or more cycles. The temperatures at which the stages are carried out will generally be at temperatures from about 0° C. to about 100° C., preferably about 60° C. to 100° C., when atmospheric pressure is employed. If higher pressures are employed the temperature can be as high as about 300° C. If salts such as ammonium carbonate and bicarbonate are used, which decompose at temperatures greater than about 50° C., elevated pressures must be used as indicated previously.

In the practice of the present invention, when more than one pH stage is employed, the coal is contacted in a first stage with the aqueous ammonium salt solution for an effective amount of time in an appropriate reactor at an effective temperature and in a pH range selected from the group consisting of 0.5 to 5, 5 to 9, and 9 to 12. Effective amount of time means for a time sufficient to remove a desired amount of minerals from the coal. It will be appreciated that the specific amount of time will be dependent on such things as temperature, specific ammonium salt, the amount of ammonium salt, pressure, and size and type of the coal employed.

The selection of the pH range will be dependent on the particular mineral composition of the coal. For example, if it is desirable to preferentially remove quartz, then the pH of the first stage is conducted in the pH range of about 0.5 to 5, whereas if it is desirable to preferentially remove the clay minerals, then the first stage is conducted in the pH range of about 9 to 12. If the coal has a relatively high carbonate mineral content, it may be desirable to conduct the first pH stage in the range of about 5 to 9, in order to have the decomposition of the carbonate mineral matter occur with a regenerable reagent, e.g. an ammonium salt. After treating the coal in a first pH stage, it may be desirable to employ a second, and possibly a third pH stage depending on the type and amount of mineral matter remaining in the treated coal. For example, if carbonate mineral matter is removed from coal in a first stage at a pH of about 0.5 to 5, a second stage can be conducted in a pH range of about 0.5 to 5 to preferentially remove quartz. If the economics of the process dictate, it may be desirable to conduct a third state in a pH range of about 9 to 12 to preferentially remove clay mineral matter. Of course, any one, or combination of such stages, may be conducted depending on the particular coal and the desired richness of the final product. It is preferred that if a pH range of 5 to 9 is conducted to remove carbonate mineral matter it is conducted in the absence of an organic solvent to facilitate the rate of the reaction. It is preferred that the other two stages be conducted in the presence of a solvent to facilitate the separation of the organic matter from the mineral matter of the coal.

After the predetermined amount of carbonate mineral matter has been removed from the coal, in the pH range of 5 to 9 the result is a two phase system. That is, there will be an upper aqueous phase and a lower solids phase. Carbon dioxide and ammonia gas which evolve during the decomposition of minerals can be recovered and used in the regeneration of the ammonium salt. The resulting solid phase, which is higher in organic content than the starting coal, can be passed to a second stage and treated with a solution preferably containing ammonium ions, ammonia, or both, for an effective amount of time at an effective temperature.

After treatment in a pH stage of 0.5 to 5 or 9–12 which are conducted in the presence of a solvent and the desired amount of mineral matter has been removed, the result is a three phase system. That is, there will be an upper organic solvent phase, a middle aqueous phase, and a lower solids phase. The upper phase will be rich in organic material from the oil-shale, which organic material may be separated from the solvent by conventional distillation or other appropriate techniques. The aqueous phase contains dissolved mineral matter and excess ammonium salt and the lower solids phase is primarily coal or oil-shale mineral matter.

The ammonium salt solution should be present in at least a stoichiometric amount based on the amount of of carbonate minerals present in the starting coal or oil-shale. Generally, a 1 to 4 molar solution of the ammonium salt is adequate.

The following examples serve to more fully describe the manner of practicing the above-described invention as well as to set forth the best modes contemplated for carrying out various aspects of the invention. It is to be understood that these examples in no way serve to limit the true scope of this invention, but rather, are presented for illustrative purposes.

EXAMPLES (Comparative)

3 g of Green River oil-shale containing 20.6 wt.% organic material and 40 wt.% carbonate minerals and in 80–100 mesh particle size was charged into a reactor containing a magnetic stir bar. A 1M solution of ammonium sulfate (30 mL) was then charged into the reactor and the mixture was heated at 100° C. with stirring for 48 hours under a nitrogen atmosphere. The reaction mixture was then cooled to room temperature (about 20° C.) and filtered through a Teflon filter paper lined Buchner funnel. The resulting beneficiated oil-shale was then dried in a vacuum oven at 100° C. overnight and analyzed for weight loss. The weight loss represents the amount of carbonate minerals removed from the oil-shale. It was found that the solids phase weighted about 40% less than the starting oil-shale sample. This indicates that the oil-shale sample lost about 40 wt.% of its mineral matter thus leaving a beneficated product having about 35 wt.% organic material, based on the total weight of the material.

EXAMPLE 2 (Comparative)

A sample of Green River oil-shale (3 g) having the same organic and carbonate minerals as that used in the previous examples was charged in a reactor with of a 1M aqueous ammonium sulfate solution (30 mL) and 4 wt.% of the monoethanolamine salt of $C_{12}$ benzenesulfonic acid (anionic surfactant). The 4 wt.% was based on the total weight of the ammonium salt solution. The reaction mixture was maintained at a temperature of 80° C. for 72 hours after which it was cooled to room temperature. The result was an upper aqueous phase and a lower phase. The lower phase also appeared to be composed of two distinct layers based on color, an upper tan layer and a lower dark brown layer. At first it was thought that the upper layer was a mineral rich layer and the lower layer an organic or kerogen rich layer. After analysis, the upper layer was found to be comprised of 27.9 wt.% organic material and the lower layer was found to be comprised of 27.7 wt.% organic material, both weight percents based on the total weight of the samples from the particular layer. Consequently, what appeared at first to be two chemically distinct layers turned out to be two layers of two different colors but having substantially the same composition.

The examples demonstrate that an anionic surfactant is unsuitable for separating the mineral matter from the organics in the so-called solids phase resulting from the treatment of oil-shale with an ammonium salt solution.

EXAMPLE 3 (Comparative)

The procedure of Comparative Example 2 above was followed except the cationic surfactant ethoquad $C_{12}$, methyl- bis- (2-hydroxyethyl)-cocoammonium chloride, was used in place of the anionic surfactant.

The resulting solids phase showed a weight loss of 34.9 wt.% which indicated that substantial demineralization of the oil-shale had occurred.

The results was the same as in Comparative Example 2 above except the upper tan layer was found to be comprised of 35.8 wt.% organic material. Thus, cationic surfactants are no better than anionic surfactants for separating organic material from mineral matter of the resulting lower phase produced upon the treatment of oil-shale with an ammonium salt solution.

EXAMPLE 4

The procedure of Comparative Example 2 above was followed except that the nonionic surfactant Igepal CO 730, an ethoxylated nonyl phenol containing 15 moles of ethylene oxide, was used in place of the anionic surfactant.

The result was similar to the above two examples in that an upper aqueous phase was formed and a lower solids-like phase. The lower solids-like phase also was composed of two layers, a tan upper layer and a dark brown lower layer. This example differed from the above examples in that the upper tan layer was found to contain 8.2 wt.% organic material and the lower dark brown layer was found to contain 45.5 wt.% organic material.

Thus, only the nonionic surfactant was able to both removed mineral matter from the oil-shale *and* effect substantial separation of the organic and mineral matter of the beneficiated product.

EXAMPLE 5

A reaction mixture containing 4 g Green River oil-shale, 40 ml of 1M ammonium sulfate solution 0.16 g of Igepal CO 730 surfactant and 25 ml of toluene was heated to and maintained with stirring at 85° C. under a nitrogen atmosphere for 72 hours. At the end of the 72 hour reaction period, there was a dark brown top layer of oil-shale organics dispersed in toluene, a substantially clear aqueous middle layer, and a white solids mineral matter bottom layer. The reaction mixture was allowed to cool to room temperature and the top organic layer was separated, filtered, and washed with distilled water and methanol to wash away residual surfactant and toluene from the oil-shale organics. The solids layer was also filtered and washed with water and methanol. Both solid materials, from the toluene layer and the solids layer, which remain after filtering were dried for about 16 hours at 100° C.

Analysis of the solids from the toluene layer revealed an organic content of 61 wt.% whereas the solids from the bottom mineral layer contained only 4.2 wt.% organics. This shows that by use of an organic solvent with the ammonium salt a beneficiated oil-shale material can be obtained containing about three times as much organic material as the starting material.

EXAMPLE 6

The above example was repeated except no surfactant was used. The result was virtually identical to the above example except the solids from the toluene layer contained 62 wt.% organic material and the solids from the bottom layer contained 7 wt.% organic material.

Examples 5 and 6 demonstrate that although a nonionic surfactant is not critical for separating organic rich material from mineral rich material of residue remaining upon treating oil-shale with an aqueous ammonium salt solution in the presence of a solvent, it does allow a slightly higher degree of separation if desired.

EXAMPLE 7

A 250 mL round-bottom flask was charged with Illinois No. 6 coal (5.10 g) which contained 9.94 wt.% $SO_3$ free ash (0.507 g), and a magnetic stir bar. Xylenes (50 mL) containing Illinois No. 6 coal bottoms (0.09 wt.%) in solution, was next charged into the vessel. A cooling condenser with a nitrogen blanket supply was attached.

While stirring, the reaction mixture was heated to and maintained at 90° C. for 10 minutes. Ammonium sulfate (100 mL of a 2M solution preheated to 90° C.) was charged into the vessel and stirring was continued for 66 hours.

The heat was removed and the stirring stopped. It was observed that the aqueous phase contained finely dispersed, light-gray colored solids and the organic layer was black and contained most of the starting material.

The aqueous layer was removed using a separatory funnel. Both the organic and aqueous layers were filtered through Teflon-lined Buchner funnels. The remaining solids in each were washed with xylenes ($2\times200$ mL), water ($6\times500$ mL), and methanol ($3\times300$ mL). After 2 hours of nitrogen blanketing/vacuum drying, each product was weighed: float fraction (4.63 g) and sink fraction (0.11 g).

Thermogravimetric analysis showed that the sink fraction contained 90 wt.% ash. Elemental analysis of the float fraction showed it to contain 5.94 wt.% $SO_3$ free ash (0.275 g). This is a 45.8% reduction of the ash with greater than 97% recovery of the organic material.

EXAMPLE 8

Wyodak coal (5.14 g) containing 7.33 wt.% $SO_3$ free ash (0.377 g), was treated as in Example 7, except that the 50 mL of xylenes contained 0.025 wt.% Wyodak coal bottoms in solution. The same 66 hours of reaction time was employed and the work-up was the same. The resulting float fraction weighed 4.70 g and the sink fraction weighed 0.04 g.

Thermogravimetric analysis of the sink fraction showed it to contain 84 wt.% ash. Elemental analysis of the float fraction showed it to contain 4.04 wt.% $SO_3$ free ash (0.190 g) and that greater than 96% of the original organics had been recovered. This ash value represents a 49.6% reduction in the starting ash content.

EXAMPLE 9

Martin Lake, Texas lignite bitumen (4.99 g), containing 15.64 wt.% $SO_3$ free ash (0.780 g), was treated as in Example 1, except that the 50 mL of xylenes contained 0.205 wt.% Martin Lake, Texas lignite bitumen in solution. The same 66 hours of reaction time was employed and the work-up was the same. The resulting float fraction weighed 4.35 g and the sink fraction weighed 0.31 g.

Thermogravimetric analysis of the sink fraction showed it to contain 95 wt.% ash. Elemental analysis of the float fraction showed it to contain 5.99 wt.% $SO_3$ free ash (0.26 g) and that greater than 97% of the original organics had been recovered. This ash value represents a 66.6% reduction in the starting ash content.

EXAMPLE 10

Procedure for a Second Stage De Mineralization of Martin Lake, Texas Lignite

The product float fraction of Martin Lake, Texas lignite from Example 9 above was divided into three samples and treated again. Each sample, (1.30 g) containing 5.99 wt.% $SO_3$ free ash (0.08 g), was treated as in Example 9, except that the ammonium sulfate, aqueous layer was varied in pH. The first sample had conc. sulfuric acid added to the 2M ammonium sulfate solution to lower the pH to 2.5. The second sample involved only the 2M solution (pH 5.3). The third sample had conc. ammonium hydroxide added to raise the pH to 11.0.

Each reaction was run at 90° C., except that the higher pH treatment was run at only 70° C. because too much $NH_3(g)$ would be lost at higher temperatures resulting in lowering the desired pH. Only 22 hours of reaction time was employed and the work-up was the same as in the previous examples.

Treatment of the first sample at a pH of 2.5 resulted in a float fraction weight of 1.10 g. Elemental and analysis showed it to contain 3.27 wt.% $SO_3$ free ash. This ash value represents an overall reduction of 82.6 wt.% of the whole lignite's $SO_3$ free ash.

Treatment of the second sample at a pH of 5.3 resulted in a float fraction weight of 1.12 g. Elemental analysis showed it to contain 4.00 wt.% $SO_3$ free ash. This ash value represents an overall reduction of 78.3 wt.% of the whole lignite's $SO_3$ free ash.

Treatment of the third sample at a pH of 11.0 resulted in a float fraction weight of 1.04 g and a black sink fraction weight of 0.04 g. Elemental analysis showed that the float fraction contained 1.43 wt.% $SO_3$ free ash, which represents an overall reduction of 92.8 wt.% of the whole lignite's $SO_3$ free ash. However, analysis of the sink fraction showed it to contain only 40.3 wt.% ash and 59.7 wt.% organics. This value represents a 2 wt.% loss of organics to the sink fraction which did not occur in the two, lower pH systems.

EXAMPLE 11

A 250 mL round-bottom flask was charged with Illinois No. 6 coal (5.02 g), which contained 9.94 wt.% $SO_3$ free ash (0.49 g), and a magnetic stir bar. Xylenes (50 mL) and ammonium sulfate (100 mL of a 2M solution) were next charged into the vessel. A cooling condenser with a nitrogen blanket supply was attached.

While stirring, the reaction mixture was heated to and maintained at 90° C. for 66 hours. The work-up used was the same as the previous two examples. The resulting float fraction weighed 4.56 g and the sink fraction weighed. 0.05 g.

Thermogravimetric analysis of the sink fraction showed it to contain 84.5 wt.% ash. Elemental analysis of the float fraction showed it to contain 7.06 wt.% $SO_3$ free ash (0.32 g) and that greater than 92% of the original organics had been recovered. This ash value represents only a 35.9% reduction in the starting ash content and illustrates that the presence of a coal derived liquid, as in Example 7, gives better results.

What is claimed is:

1. A process for beneficiating coal which process comprises contacting the coal with (a) an ammonium salt solution and (b) an organic solvent, at a temperature from about 0° C. to about 300° C.

2. The process of claim 1 wherein the temperature is from 0° C. to about 100° C. and atmospheric pressure is used.

3. The process of claim 1 wherein the ammonium salt solution contains one or more salts selected from the group consisting of ammonium carbonate, ammonium bicarbonate, ammonium acetate, ammonium chloride, ammonium nitrate, ammonium sulfate, and ammonium phosphates.

4. The process of claim 3 wherein the ammonium salt solution contains one or both of ammonium nitrate and ammonium sulfate.

5. The process of claim 1 wherein the organic solvent is selected from the group consisting of toluene, heptane, BTX streams, cyclohexane, petroleum and coal derived fractions, and boiling point fractions of oil-shale liquids.

6. The process of claim 5 wherein the solvent, by volume, to aqueous solution is from about 0.4:1 to 2.

7. The process of claim 6 wherein the solvent is a boiling point fraction of coal liquids.

8. The process of claim 5 wherein the ammonium salt solution contains one or more salts selected from the group consisting of ammonium carbonate, ammonium bicarbonate, ammonium acetate, ammonium chloride, ammonium nitrate, ammonium sulfate, and ammonium phosphates.

9. The process of claim 8 wherein the ammonium salt solution contains one or both of ammonium nitrate and ammonium sulfate.

10. The process of claim 1 wherein a nonionic surfactant is present.

11. The process of claim 8 wherein a nonionic surfactant is present.

12. The process of claim 10 wherein the nonionic surfactant is an ethoxylated derivative of a compound selected from the group consisting of phenols, amines, carboxylic acids, alcohols, mercaptans, and polyhydroxides.

13. The process of claim 12 wherein the surfactant is an ethoxylated phenol having the formula:

$$(R)_rA—[O(CH_2CH_2O)_p]_qH$$

wherein R is a $C_1$ to $C_{24}$ alkyl group, A is benzene, naphthalene or diphenyl, p is 2 to 60, q is 1 or 2, and r is 1 to 5 with the proviso that when r is 1, R is at least a $C_8$ alkyl group.

14. The process of claim 12 wherein the surfactant is an ethoxylated amine represented by the formula:

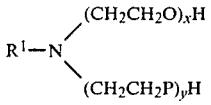

where $R^1$ is a $C_8$ to $C_{30}$ aliphatic radical and the sum of $x+y$ is from 2 to 30.

15. A process for beneficiating coal which process comprises contacting the coal in two different stages with an aqueous ammonium salt solution wherein the stages are characterized as follows:

stage 1 is conducted at pH in the range of about 5 to 9 in the presence of an aqueous ammonium salt solution;

stage 2 being conducted at a pH in the range of about 0.5 to 5 or about 9 to 12 in the presence of an organic solvent at a temperature in the range of about 0° C. to about 300° C. for an effective amount of time.

16. The process of claim 15 wherein the temperature of any one or more of the stages is from about 0° C. to about 100° C.

17. The process of claim 15 wherein the ammonium salt solution of any one or more of the stages contains one or more salts selected from the group consisting of ammonium carbonate, ammonium bicarbonate, ammonium acetate, ammonium nitrate, ammonium sulfate, and ammonium phosphates.

18. The process of claim 17 wherein the ammonium salt solution of any one or more of the stages contains one or both of ammonium nitrate and ammonium sulfate.

19. The process of claim 15 wherein a third stage is conducted at a pH in the range of about 0.5 to 5 or about 9 to 12 in the presence of an organic solvent with the proviso that the pH of stage 2 and 3 not be in the same range.

20. The process of claim 19 wherein the organic solvent of steps 2, 3, or both is selected from the group consisting of toluene, heptane, BTX streams, cyclohexane, petroleum and coal derived fractions, and boiling point fractions of oil-shale liquids.

21. The process of claim 20 wherein the solvent to aqueous solution ratio, by volume, is about 0.4:1 to 2.

22. The process of claim 21 wherein the solvent is a boiling point fraction of coal liquids.

23. The process of claim 20 wherein the ammonium salt solution contains one or more salts selected from the group consisting of ammonium carbonate, ammonium bicarbonate, ammonium acetate, ammonium chloride, ammonium nitrate, ammonium sulfate, and ammonium phosphates.

24. The process of claim 23 wherein the ammonium salt solution contains one or both of the ammonium nitrate and ammonium sulfate.

25. The process of claim 15 wherein a nonionic surfactant is present.

26. The process of claim 23 wherein a nonionic surfactant is present.

* * * * *